United States Patent [19]

Hanafusa

[11] Patent Number: 4,872,597

[45] Date of Patent: Oct. 10, 1989

[54] BEVERAGE CONTAINER WITH DUAL DISPENSING TABS

[76] Inventor: Hisao Hanafusa, 20 Confucius Plaza - #34-F, New York, N.Y. 10002

[21] Appl. No.: 257,484

[22] Filed: Oct. 13, 1988

[51] Int. Cl.[4] ..... B65D 47/10

[52] U.S. Cl. ..... 222/541; 220/269; 220/270; 220/379; 222/545

[58] Field of Search ..... 222/541, 538, 543, 545, 222/565, 572; 215/255, 256; 220/269, 270, 271, 272, 273, 276, 254, 379

[56] References Cited

U.S. PATENT DOCUMENTS

| | | | |
|---|---|---|---|
| 1,329,184 | 1/1920 | Hyams | 222/538 |
| 3,494,500 | 2/1970 | Foster | 220/269 |
| 3,701,454 | 10/1972 | Thorp | 222/541 X |
| 3,838,788 | 10/1974 | Stargell | 220/271 |
| 4,177,929 | 12/1979 | Murray | 220/379 X |
| 4,210,257 | 7/1980 | Radtke | 220/269 |
| 4,682,702 | 7/1987 | Gach | 220/270 X |

FOREIGN PATENT DOCUMENTS

| | | | |
|---|---|---|---|
| 158132 | 10/1978 | Netherlands | 220/270 |

*Primary Examiner*—Kevin P. Shaver
*Attorney, Agent, or Firm*—Salzman & Levy

[57] ABSTRACT

The invention features a beverage container having a small and a large liquid dispensing opening. Each opening is operatively caused to be unsealed by the action of respective finger tabs. The two tabs act independently of each other despite being interleaved for the purpose of a compact design. The large opening features the unsealing of an entire lid portion of the container.

15 Claims, 1 Drawing Sheet

BEVERAGE CONTAINER WITH DUAL DISPENSING TABS

FIELD OF THE INVENTION

The invention relates to beverage containers having a sealed opening which is ruptured by the pulling of a tab disposed upon the lid, and more particularly to a beverage container having two tab-rupturable openings for dispensing the beverage at different flow rates.

BACKGROUND OF THE INVENTION

The aluminum beverage can in commercial use at the present time, features a small, elliptical, sealed opening that is ruptured when a tab is pulled upwardly from the lid.

Such a beverage container opening works well with the use of a straw, which is easily capable of withdrawing a sufficient amount of the beverage from the can.

However, the small elliptical opening does not provide for a smooth fluid flow, when the can is inverted in a pour-like mode. Because of its small size, the elliptical opening gives a surging or restricted flow, since the outside air which needs to enter the can during the outward flow of beverage, competes for the small space provided by the elliptical opening.

For those individuals who drink directly from the lid of the container, such flow is often accompanied by the effects of dribbling.

In addition, the small size of this type of opening makes it difficult to remove the last drops of fluid from the container.

Another undesirable feature of this type of can dispensing system is the tab, which easily breaks away from the lid. This break-away tab is a constant source of environmental pollution, since it is tossed away and has littered the country-side. Because the tabs are aluminum, they do not degrade, and have become a blighted eye-sore in the environment.

The present invention seeks to overcome the disadvantage of the current beverage container by providing an additional opening in the can, wherein the entire lid is removable. The additional opening acts independently of the small, elliptical aperture, and thus offers the user a choice of dispensing flow rates.

In addition, the current invention also features a recess in the bottom of the can for capturing a removed lid. In this way, when the can is discarded, there is no residual tabs which pollute the environment.

SUMMARY OF THE INVENTION

The invention pertains to a beverage container having a hollow tubular member for storing and dispensing a beverage.

A generally flat-surfaced lid is disposed on top of the tubular member.

The lid is removable from the tubular member by means of tearing the lid along a scored line disposed about its periphery.

A first tab secured to the lid and attached to the scored line, causes a rupturing of the scored line upon an initial pulling thereof. The lid will be torn from the tubular member upon a further pulling of the tab.

The beverage can has a small, elliptical, sealed aperture as before, which is disposed eccentrically within the scored line of the lid.

A second tab attaches to the scored line of the aperture causes the seal to be broken upon a pull thereof.

Each tab works independently of the other, such that neither tab will interfere with the operation of the other, despite the fact that the tabs are structurally interleaved.

The two openings afford the user a choice between a partial or full flow dispensing of the liquid of the container.

One of the many advantages of the invention, is the aesthetic design wherein each tab nests within the other, but still maintains an independent functionality.

It is an object of the invention to provide a beverage container that has a dual dispensing capability;

It is another object of this invention to provide a beverage can whose entire lid can be removed and stored in a bottom recess thereof;

It is a further object of the invention to provide a beverage can that can be retained after dispensing its liquid as a container for household uses.

These and other objects of this invention will become clearer and more apparent with reference to the accompanying drawings and detailed discussion.

BRIEF DESCRIPTION OF THE DRAWINGS

A complete understanding of the present invention may be obtained by reference to the accompanying drawings, when taken in conjunction with the detailed description thereof and in which.

DESCRIPTION OF THE PREFERRED EMBODIMENT

Generally speaking, the invention features a beverage container having two separate and distinct dispensing modes. The container has two interleaved or nested tabs for opening different portions of the lid, in order to provide a slow or fast beverage dispensing flow rate. Although the two tabs are interleaved, they function independently of each other.

For the purposes of brevity, like elements will bear the same designation throughout the figures.

Figure 1:
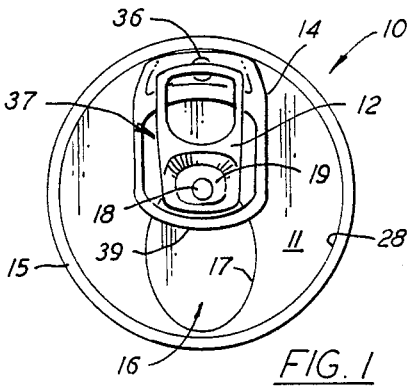
FIG. 1 is a top view of the beverage container of this invention.
Figure 2:
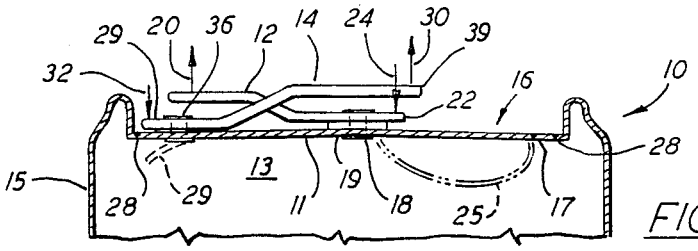
FIG. 2 is a partial sectional view of the beverage container of FIG. 1.

Now referring to FIGS. 1 and 2, a beverage container (arrow 10) is shown having a lid 11 which carries two opening tabs 12 and 14, respectively.

The opening tabs 12 and 14 are interleaved, as shown more clearly in FIG. 2, but function independently of each other, as will be explained in more detail, hereinafter.

The beverage container comprises a thin walled, hollow, aluminum tube 15 (FIG. 2) which stores and dispenses the beverage.

A small opening 16 in the lid 11 is defined by a scored line 17 in the shape of an ellipse. Tab 12 is secured to lid 11 by a rivet 18 attaching a lip 19 of tab 12 to the lid 11.

When the tab 12 is pulled upwardly (arrow 20), as depicted in FIG. 2, the tip 22 of the tab 12 is caused to press (arrow 24) against the top of opening 16, thus rupturing the seal provided by the scored line 17. The pressure caused by the tip 22 forces the scored line 17 to tear and depress portion 25, (shown in phantom) of the lid 11 into the interior cavity 13 of container 10. This allows fluid to be dispensed from the cavity 13 in container 10 through aperture 16.

A second opening in lid 11 is defined by the scored line 28 which encircles the periphery of lid 11.

When tab 14 is pulled upwardly (arrow 30), the tip 29 of tab 14 is caused to be depressed (arrow 32),thus rupturing the seal along score line 28, and forcing the tip 29 (shown in phantom) into interior cavity 13.

The downward movement of tip 29 is caused by the upward pull (arrow 30) of tab 14 by reason of the securing rivet 36. Securing rivet 36 attaches tab 14 to the lid 11, and acts as fulcrum. Therefore, tip 29 pivots downwardly about rivet 36 when the tab 14 is pulled upwardly (arrow 30).

When tab 14 is subsequently pulled further upwardly by gripping tab 14 with a finger through hole 37 (FIG. 1), the entire lid 11 is torn along the scored line 28 about the circumferential length, and upwardly removed from tube 15.

Thus, a large, smooth-edged opening is provided in can 11, such that can 11 has the flow rate characteristic of a drinking glass.

Each tab 12 or 14 can be pulled upwardly independently of the other, despite being interleaved. The interleaved design has as its purpose to provide a compact and aesthetically pleasing mechanism.

The end 39 of tab 14 is also designed so that it does not extend over, or interfere with, the opening 16.

Figure 3:
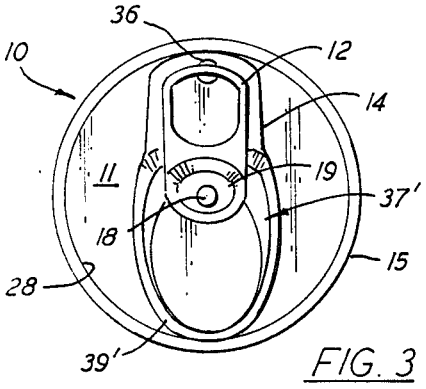
FIG. 3 is a top view of an alternate embodiment of the invention shown in FIG. 1.
Figure 4:
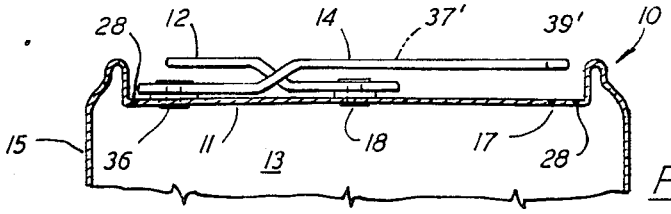
FIG. 4 is a partial sectional view of the alternate embodiment of FIG. 3.

In another embodiment shown in FIGS. 3 and 4, the end 39' of tab 14 extends to the periphery of lid 11, but aperture 16 is left unobstructed because of larger hole 37' in tab 14. The larger hole 37' also has the advantage of making it easier to grip the tab 14 with the finger.

Figure 5:
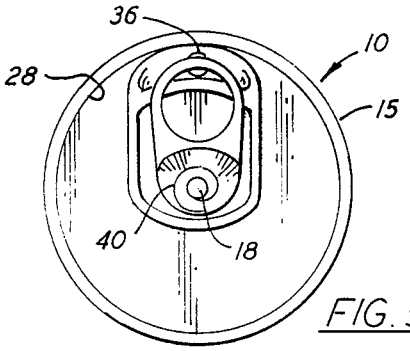
FIG. 5 is a top view of another alternate embodiment of the invention illustrated in FIG. 1.
Figure 6:
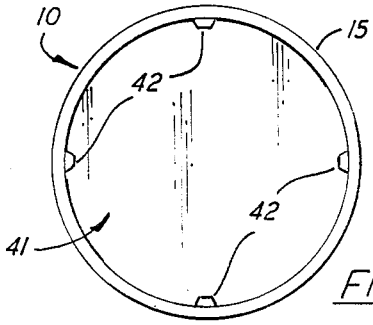
FIG. 6 is a bottom view of the beverage container invention depicted in FIG. 1.

In still another embodiment of the invention, shown in FIG. 5, the hole 16 is replaced by a spiral-shaped scored line 40, which allows for a small opening to be made in the center of container 10 for a straw. The bottom of the container 10, depicted in FIGS. 6 and 7 is exemplified by recess 41.

Figure 7:
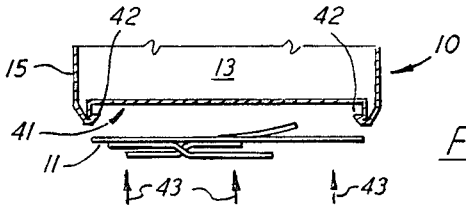
FIG. 7 is a partial sectional view of the beverage container illustrated in FIG. 6.

The recess 41 is placed in the bottom of the can 11 in order to provide storage disposal for the removed lid 11, illustrated in FIG. 7.

Four protuberances 42 are equally spaced about the peripheral of tube 15, creating holding fingers for lid 11, which is pressed into recess 41 (arrows 43), as shown.

Protuberances 42 provide a snap-action locking mechanism for lid storage.

Having thus described the invention, what is desired to be protected by Letters Patent is presented by the subsequently appended claims.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

What is claimed is:

1. A beverage container for soda or beer beverage, comprising a tubular member for storing and dispensing said beverage, said tubular member having a removable sealed lid, a first pull tab for unsealing and tearing said lid from said tubular member, means defining a sealed aperture upon said lid, and a second pull tab secured to said lid for unsealing said aperture, and wherein said first and second pull tabs are interleaved with respect to one another.

2. The beverage container of claim 1, further comprising means for storing a removed lid of said tubular member.

3. The beverage container of claim 1, wherein said tabs can be pulled independently of each other.

4. A beverage container comprising:

a hollow tubular member for storing and dispensing a beverage;

a generally flat-surfaced lid disposed on top of said tubular member, said lid being removable from said tubular member by tearing said lid along a scored line disposed about a peripheral portion thereof;

a first tab secured to said lid, said first tab having a section thereof attached to said peripheral scored line, wherein said scored line will be caused to be ruptured upon an initial pull of said first tab, and further wherein said lid will be torn from said tubular member upon a further pull of said first tab;

means defining a sealed aperture disposed upon a surface of said lid, said sealed aperture further defined by a scored line about its periphery; and a second tab secured to said lid, said second tab having a section thereof attached to the aperture scored line, wherein said scored line will be caused to be ruptured and said aperture caused to become unsealed upon a pull of said tab, and further wherein said first and second tabs are interleaved, one within the other, whereby they operate independently of each other.

5. The beverage container of claim 4, wherein said first and second tabs are disposed upon said lid in non-interfering proximity to each other.

6. The beverage container of claim 4, wherein said sealed aperture has a substantially elliptical shape.

7. The beverage container of claim 4, wherein said sealed aperture is eccentrically disposed within the scored line periphery of said lid.

8. The beverage container of claim 4, wherein said scored line of said aperture has a spiral appearance.

9. The beverage container of claim 4, further comprising means defining a recess in a bottom portion of said tubular member for storing a removed lid.

10. The beverage container of claim 9, wherein said recess is defined at its periphery by a circumferential wall of said tubular member, and further wherein said periphery is distinguished by dimpled projections extending from the circumferential wall for capturing and holding said lid for storage disposal.

11. A beverage container comprising:

a hollow tubular member for storing and dispensing a beverage;

a generally flat-surfaced lid disposed on top of said tubular member for sealing said beverage in said tubular member;

means defining a first sealed opening in said lid, wherein said beverage is dispensable when said opening is unsealed, at a limited flow rate therefrom;

first opening means disposed upon said lid for unsealing said first sealed opening;

means defining a second sealed opening in said lid, wherein said beverage is dispensable when said second opening is unsealed, with a greater rate of flow with respect to said limited flowrate of said first opening means; and a second opening means disposed upon said lid adjacent and independent of said first opening means for unsealing said second sealed opening independently of said first sealed opening and said first opening means, whereby said beverage can be dispensed from said tubular member with a choice of two separate flow rates, and wherein said first and second opening means include first and second pull tabs, respectively interleaved one within the other upon said flat-surfaced lid and being operatively independent of each other.

12. The beverage container of claim 11, wherein said first and second sealed openings include two eccentric score lines disposed one within the other upon said lid

13. The beverage container of claim 12, wherein said second sealed opening is defined by a score line disposed about a periphery of said lid for that purpose of removing substantially the entire lid from said tubular member.

14. The beverage container of claim 13, further comprising means defining a recess in a bottom portion of said tubular member for storing a removed lid.

15. The beverage container of claim 14, wherein said recess is defined at its periphery by a circumferential wall of said tubular member, and further wherein said periphery is distinguished by projetions extending from the circumferential wall, which projections capture and hold said lid for storage disposal.

* * * * *